United States Patent [19]

Chaumat et al.

[11] 4,296,791

[45] Oct. 27, 1981

[54] FOLDING DOOR OR LIKE CLOSURE DEVICE

[76] Inventors: Bernard Chaumat, 10 Bd. Jourdan, 75014 Paris; Georges Gallet, 6 rue du 11 Novembre, 95110 Sannois; Jacques Lamare, 21 Bd. Richard Wallace, 92200 Neuilly-sur-Seine; Guy Peyssard, 30 rue Raze, 33000 Bordeaux, all of France

[21] Appl. No.: 114,429

[22] Filed: Jan. 22, 1980

[30] Foreign Application Priority Data

Jan. 25, 1979 [FR] France ..... 79 01931

[51] Int. Cl.[3] ..... E05D 15/26

[52] U.S. Cl. ..... 160/206; 160/229 R

[58] Field of Search ..... 160/199, 206, 118, 229 R

[56] References Cited

U.S. PATENT DOCUMENTS

| | | | |
|---|---|---|---|
| 1,396,780 | 11/1921 | Pugh | 160/206 |
| 1,626,764 | 5/1927 | Thorne | 160/199 |
| 3,437,125 | 4/1969 | Hargrove | 160/199 X |
| 3,448,786 | 6/1969 | Edgerton, Jr. | 160/199 |
| 4,095,310 | 6/1978 | Governale | 160/206 X |

FOREIGN PATENT DOCUMENTS

| | | |
|---|---|---|
| 380156 | 6/1931 | Belgium . |
| 2720728 | 9/1928 | Fed. Rep. of Germany . |
| 467979 | 6/1914 | France . |
| 1196319 | 11/1959 | France . |
| 2336526 | 12/1975 | France . |
| 225702 | 12/1924 | United Kingdom . |

*Primary Examiner*—Philip C. Kannan

*Attorney, Agent, or Firm*—Young & Thompson

[57] ABSTRACT

The invention concerns a folding door of the kind having a primary panel pivoted about one axis on a frame, and a secondary panel articulated with respect to the primary panel and engaging a slide guide which is perpendicular to the pivotal axis of the primary panel.

According to the invention, the two panels are articulated by links pivotally connected to each of the primary and secondary panels at second and third axes respectively, and the secondary panel engages the slide guide at a fourth axis located at an intermediate point along the panel, all the four axes being disposed centrally of the thickness of the panels; furthermore, the distance between the second and third axes is equal to the thickness of the panels, and the distance between the third and fourth axes is the same as between the first and second axes.

With this construction, the door will open in a substantially smaller space than a conventional door and in addition it can be opened by a simple pushing action. The door is thus suitable for use by handicapped persons in e.g. hospitals and community homes.

9 Claims, 9 Drawing Figures

FOLDING DOOR OR LIKE CLOSURE DEVICE

BACKGROUND OF THE INVENTION

The present invention relates to a door or similar closure device such as a movable partition, comprising a frame, a primary panel pivoted about a first axis on the frame, and at least one secondary panel connected to the primary panel by articulation means and having means engaging a slide guide perpendicular to the said first axis.

As a rule devices of this kind are used for cupboard doors or for folding shutters of slight thickness, with hinges disposed externally in relation to this thickness.

The object of the present invention is to provide a folding door which can be used for all kinds of doors and partitions, particularly both external and internal doors of buildings and dwellings, community buildings, workshops, hospitals, and so on, the door having an extremely small area of movement and being able to have any thickness, particularly as large a thickness as desired, for example a standard thickness of four centimeters or more, while it can be opened in both directions simply by a push and which is therefore particularly suitable for operation by the handicapped; moreover, this door readily lends itself to automatic control, for example using an automatic closure mechanism.

SUMMARY

According to the invention, a door or like closure device of the above kind is characterised in that the articulation means of the two panels comprise a link articulated by two axes, referred to respectively as second and third axes, on the primary panel and on the secondary panel; in that the means of engagement of the secondary panel in the slide guide comprise an axis referred to as fourth axis and carried by the secondary panel at an intermediate point on the latter; and in that the said four axes are disposed in the middle of the thickness of the panels, the distance between the second and third axes being equal to the said thickness of the panels, while the distance between the third and fourth axes is equal to the distance between the first and second axes.

Because of this arrangement, the door is adapted to open in both directions with a small opening area. To give an example, with a door of a width of 0.90 meter the area covered by the opening of the door amounts to 1.26 square meter for a traditional door and is only 0.30 square meter for the door according to the invention.

The door performs a simultaneous lateral and rotary movement, thus permitting the use of locks of a conventional type for swing doors, with an adapted bolt. The linear movement of the fourth axis remains constant whatever the width of the door and permits the standardisation of the primary panels and of any automatic closure mechanism.

Preferably, the fourth axis is disposed in the middle of the secondary panel, thus permitting perfect symmetry of the opening movement and open position in both directions.

It will be appreciated that in the open position the arrangement provides as wide a passage as possible. It will also be noted that the door can be mounted in existing frames in place of a traditional door. The door may have any desired thickness.

The invention is also applicable to movable partitions. In this case, a plurality of secondary panels are provided one following the other, and are articulated by links similar to that connecting the primary panel to the first secondary panel.

According to another characteristic, means are provided for holding the link perpendicular to the bisector plane of the two panels. These means advantageously comprise two adjacent pulleys coaxial to the second and third axes and fastened to the two panels respectively, together with two intersecting lengths of cable, each of which has its ends fixed to the two pulleys.

In a preferred embodiment, the neighbouring sides of the two panels are semi-cylindrical and adjacent, and coaxial to the second and third axes respectively. These sides may advantageously be formed by claddings of plastic material, which enable acoustic insulation to be improved.

In one embodiment automatic closure means are provided and comprise a counterweight coupled to a cable of which one length is driven along the slide guide by a member fastened to the fourth axis. For preference, the automatic closure is controlled by hydraulic means adapted to delay the commencement and the end of the closing.

DESCRIPTION OF THE PREFERRED EMBODIMENT

Figure 3:
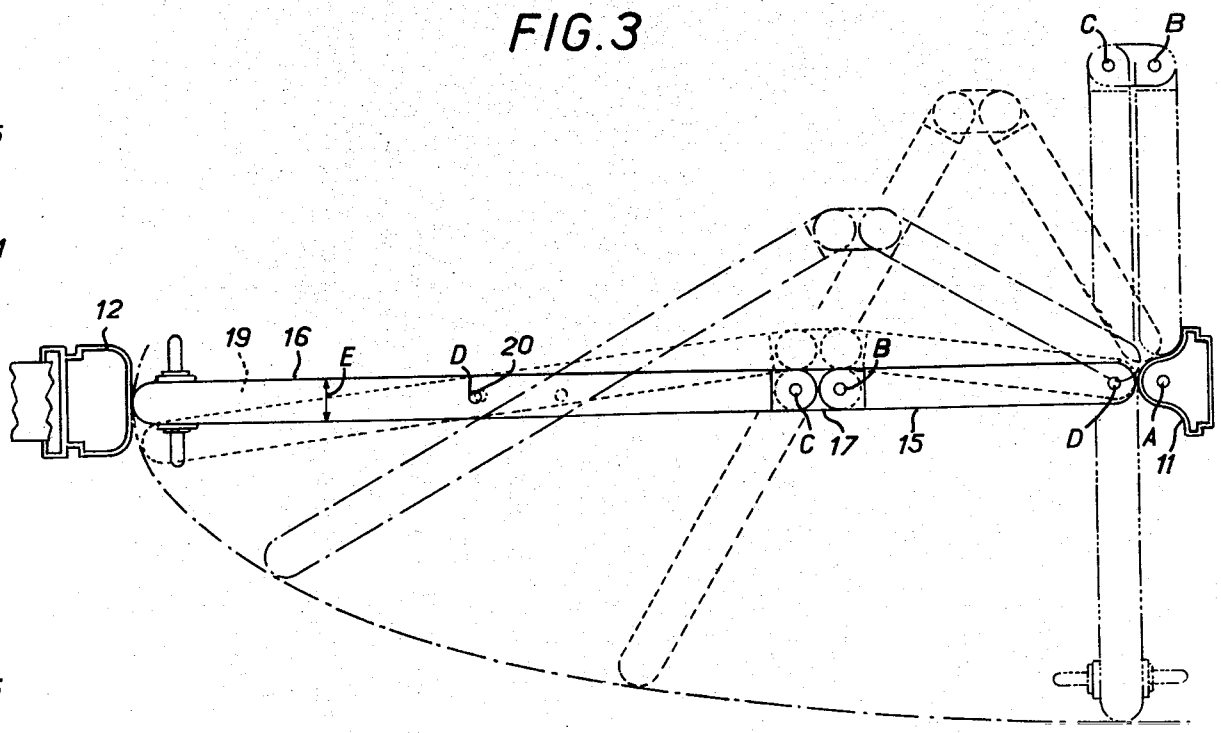
FIG. 3 is a similar view to FIG. 2, but on a larger scale, and shows the door in various positions.
Figure 1:
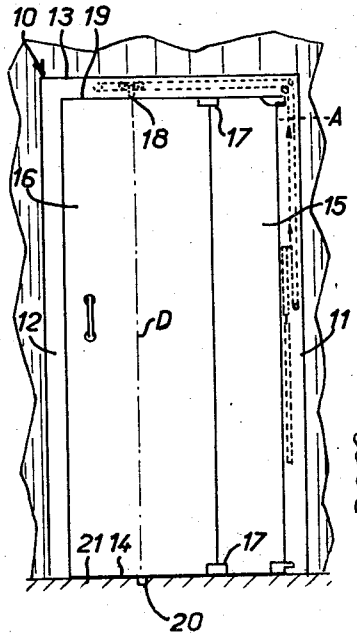
FIG. 1 is a diagrammatic view in elevation of a door according to the invention.
Figure 2:
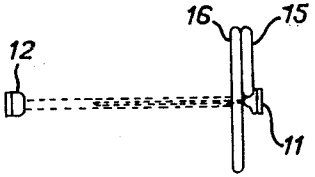
FIG. 2 is a corresponding diagrammatical plan view.
Figure 5:
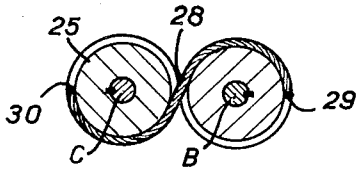
FIGS. 5 and 6 are views in section taken respectively on the line V—V and on the line VI—VI in FIG. 4.
Figure 6:
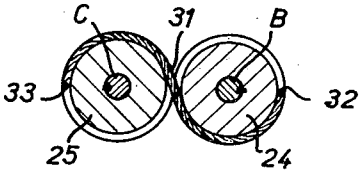

Reference will first be made to FIGS. 1 to 6.

A door according to the invention comprises a fixed frame or casing 10 (FIG. 1), comprising a first upright 11, a second upright 12, and a top cross-member 13, while a sill 14 may advantageously be provided.

The actual door is composed of a primary panel 15 and a secondary panel 16, which are articulated to one another by two links 17 disposed at the top and the bottom of the door.

The primary panel 15 is articulated on the upright 11 about a first vertical axis A (FIG. 3).

Each link 17 is articulated by two axes B and C, referred to as second and third axes respectively, on the primary panel 15 and on the secondary panel 16. The secondary panel has means of engagement in slide guides 19 and 21 perpendicular to the axis A, which are disposed at the top and botom of the door. These means of engagement comprise an axis D, referred to as fourth axis, carried by the secondary panel 16 at an intermediate point on the latter. The four axes A, B, C, D referred to are disposed in the middle of the thickness E of the panels 15 and 16. The distance between the second axis B and the third axis C is equal to the said thickness E of the panels, while the distance between the third axis C and the fourth axis D is equal to the distance between the first axis A and the second axis B.

More particularly, the axis D comprises pins 18 and 20 engaged respectively in the top and bottom slide guides 19 and 21, or only in the top slide guide 19.

Figure 4:
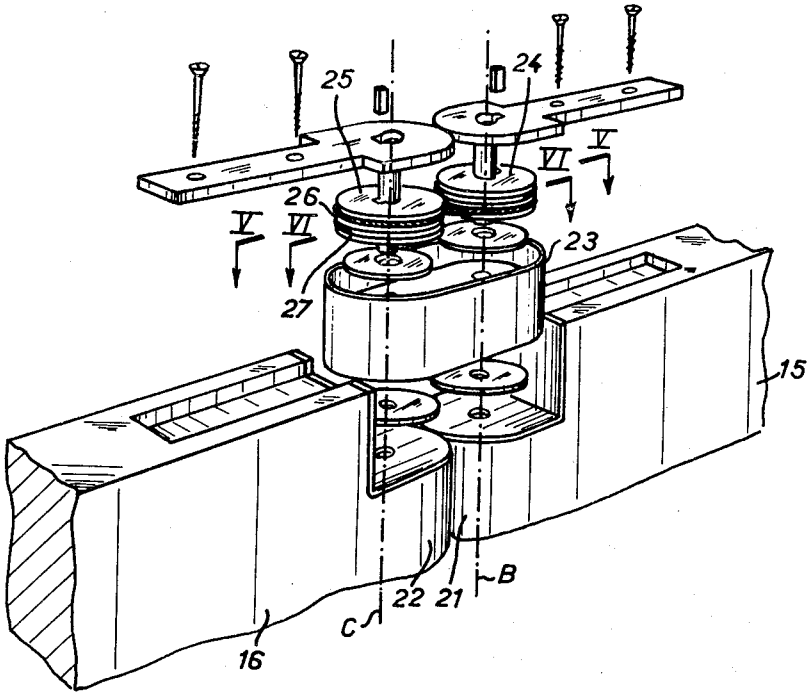
FIG. 4 is an exploded view in perspective of the mounting of the link at the top of the door.

More particular, reference will now be made to FIG. 4, where the top link 17 with its axes B and C is shown in fuller detail.

The longitudinal ends of the panels 15 and 16, by which these panels adjoin one another, are rounded in the shape of semi-cylinders coaxial respectively with the axes B and C, in such a manner that in the course of the movements of the door the semi-cylindrical ends 21 and 22 of the panels 15 and 16 always remain substantially in contact without substantial clearance, thus making it possible to give the door an excellent appearance in any position. The conditions of contact can in addition be improved by making the semi-cylindrical parts of the panels 15 and 16 of elastic or like material, thereby increasing the acoustic insulation performance of the door.

On the top end of the panels 15 and 16 are disposed, in a casing 23, two pulleys 24 and 25 coaxial respectively with the axes B and C and fastened respectively to the panel 15 and to the panel 16.

Each pulley 24 and 25 has two superposed grooves 26 and 27. In the groove 26 of the pulleys 24 and 25 is engaged a length of cable 28 (FIG. 5), of which one end 29 is fixed on the pulley 24, while the other end 30 is fixed on the pulley 25. The cable 28 passes from the pulley 24 to the pulley 25 in a first direction.

In the same way, a length of cable 31 has one end 32 fixed to the pulley 24 and one end 33 fixed to the pulley 25. This cable 31 passes from the pulley 24 to the pulley 25 in the opposite direction to that of the cable 28, so that the two cables 28 and 31 intersect (see FIGS. 5 and 6).

The arrangement comprising the two cables 28 and 31 thus makes it possible to give the assembly comprising the pulleys 24 and 25 a position which is always symmetrical in relation to the assembly comprising the panels 15 and 16. In other words, the plane B-C always remains perpendicular to the bisector plane of the panels 15 and 16.

It will be appreciated that the door may have panels 15 and 16 of a thickness E as great as is desired. Each link 17 has a thickness equal to that of the door.

As can be seen more particularly in FIG. 3, the door can be opened in either direction, and takes up extremely little space in its open position, in which the axes A, B, C and D form a perfect rectangle.

It will be noted that the door opens in both directions with a small movement area and taking up little space.

A door of this kind may have all kinds of applications, particularly in dwelling and community buildings, and it will be appreciated that it can be operated very easily by the handicapped, because it opens in both directions when simply pushed.

This door can be automated both in the opening and in the closing direction.

Figure 7:
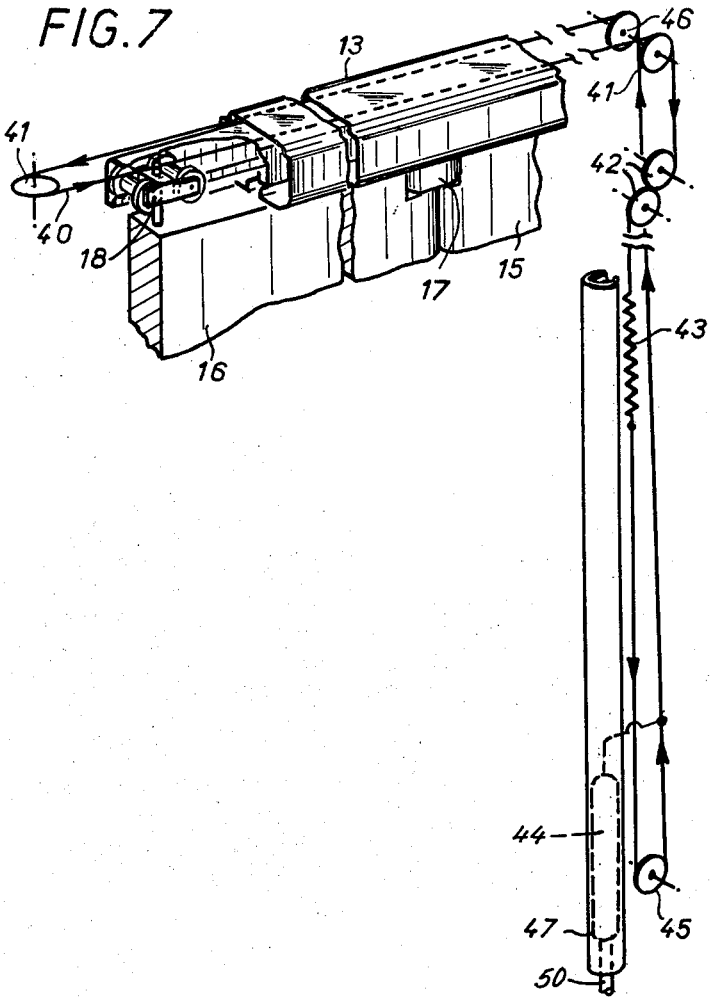
FIG. 7 is a view in perspective of a time delay closure device associated with the door.
Figure 8:
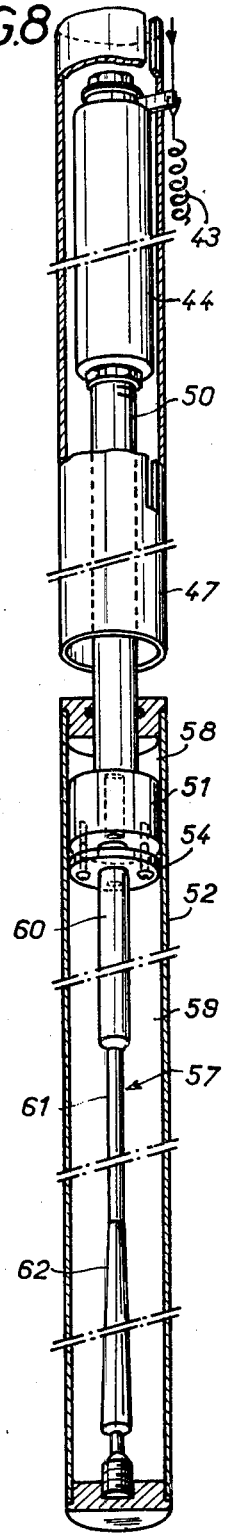
FIG. 8 is a view on a larger scale of part of this device.
Figure 9:
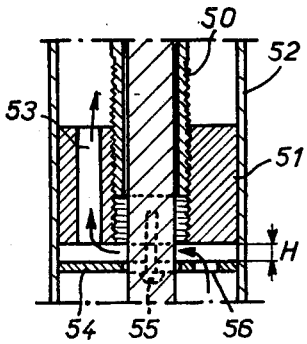
FIG. 9 is a view in section on a still larger scale of a valve in this device.

Reference will now be made to FIGS. 7 to 9, which show by way of example an automatic closure control device with time delay. This device may be disposed at will either on the pivot side or on the other side.

The pin 18 disposed at the top of the door is adapted to move in the slide guide 19. The property of this movement is utilised to achieve automatic control of closure. For this purpose a cable 40 (FIG. 7) is fastened to the translatable assembly comprising the pin 18 and passes between two pulleys 41, then passing over a pair of pulleys 42, whereupon it incorporates a tension spring 43 and is fastened to a counterweight 44 adapted to descend through gravity. The cable 40 then passes over a pulley 45 and a pulley 46, thus forming a closed loop circuit.

When the door is closed the counterweight 44 is at the bottom of an elongated cylinder 47 forming its housing. When the door is opened, the cable 40 causes the counterweight 44 to rise along its cylindrical housing 47 to its top position. Consequently, when it is released after the door has been opened the counterweight 44 tends to descend through gravity in its housing and thus drives the cable 40, bringing about the automatic closing of the door.

As will be understood, it is expedient that this automatic closure should be controlled in a manner compatible with the need for the correct passage of a person through a door. For this purpose a time delay device is provided, which will now be described (FIGS. 8 and 9).

A tubular rod 50 is fastened to the counterweight 44 and extends in the downward direction. This rod is secured to a piston 51, which is slidingly engaged in a hydraulic oil-filled cylinder 52. The piston 51 has at least one passage 53 parallel to the axis and disposed at the side of the hollow rod 50.

A disc 54 forming a valve is mounted on the piston 51 for movement between a position lying against the bottom of the piston and a position distant therefrom by a predetermined distance H, as can be seen in FIG. 9. To this end small screws 55 are mounted in the piston 51 and have their heads bearing against the disc 54. The disc 54 is provided with an aperture 56 offset in relation to the aperture 53.

A time delay rod 57 is mounted in the cylinder 52 coaxially to the latter, and is intended to penetrate into the hollow rod 50 of the piston 51 in such a manner as to free a larger or smaller space for the passage of the oil between the two chambers 58 and 59 defined in the cylinder 52 on each side of the piston 51.

As can be seen in FIG. 8, the rod 57 comprises a wide portion 60 followed by a thinner portion 61, which in turn is followed by a divergent portion 62.

When the door is closed and is pushed for the purpose of opening it, the counterweight 44 is raised from the bottom end to the top end of the cylinder 47.

As this is done, the piston 51 is raised from the bottom to the top end of the cylinder 52. In the course of this movement the oil is allowed to pass from the chamber 58 to the chamber 59, moving the disc 54 away from the piston 51, thereby permitting a large circulation flow of oil through the passages 53 and 56 which are separated by the space H.

When the door has been brought to the open position and is released, the counterweight 44 drops back in the cylinder 47, driving the cable and bringing about the automatic closing of the door. However, in the course of the movement of the piston 51 in the cylinder 52 the oil passes from the chamber 59 to the chamber 58, which has the effect of applying the disc 54 against the piston 51, suppressing the space H, and there is a very slight flow of oil through the path 56-53. At the commencement of the closing movement of the door the piston 51 is situated on the wide portion 60 of the rod 57, and consequently the flow passing through the central bore of the piston is very slight. This results in a time delay in the closing movement of the door, which gives the person proceeding through it ample time to pass. This arrangement is particularly useful when the person in question is handicapped.

Once the piston 51 passes from the wide portion 60 of the rod 57 to the narrow section 61, a large flow of oil is allowed to pass through the central passage of the piston 51 and the door is then rapidly closed without unnecessary delay.

When the piston 51 then arrives on the divergent portion 62 of the rod 57 the movement of the piston is slowed down, thus enabling the door to close gently.

It should be noted that the invention is applicable to doors or partitions having controls of any kind, particularly manual control, control with spring or counterweight or other return, automatic control of opening or closing, and so on.

We claim:

1. A door or like closure device, comprising a fixed frame, a primary panel pivoted about a first axis A on the frame and at least one secondary panel connected to the primary panel by a link articulated by a second axis B to the primary panel and a third axis C to the secondary panel, said secondary panel being in addition guided at a fourth axis D in a slide guide extending perpendicular to the first axis A, and wherein:

(i) the four axes A, B, C, and D are disposed in the centre of the thickness of the panels;

(ii) the distance between the second axis B and the third axis C is equal to the thickness of the panels;

(iii) the distance between the third axis C and the fourth axis D is equal to the distance between the first axis A and the second axis B;

(iv) the fourth axis D is carried by the secondary panel at an intermediate point thereof; and (v) means are provided for holding said link constantly perpendicular to the bisector plane of the primary and secondary panels.

2. A device according to claim 1, wherein the fourth axis D is disposed in the centre of the secondary panel.

3. A device according to claim 1, wherein said means for holding said link comprise two adjacent pulleys which are coaxial with the second and third axes and fastened to the two panels respectively, and two intersecting connecting means, each of which has its ends fixed to the two pulleys.

4. A device according to claim 1, wherein the neighbouring sides of the two panels are semi-cylindrical and adjacent and are coaxial with the second and third axes respectively.

5. A device according to claim 1, wherein two said links are provided disposed respectively at the top and bottom ends of the panels.

6. A device according to claim 1, wherein the fourth axis D comprise a pin disposed at the top of the secondary panel and engaged in said slide guide which extends at the top of the frame.

7. A device according to claim 6, wherein the fourth axis D also comprises another pin disposed at the bottom of the secondary panel and engaged in another slide guide adapted to extend along the floor.

8. A device according to claim 1, wherein automatic closure means are provided, comprising a counterweight coupled to a cable of which one portion is driven along the side guide by a member fastened to the fourth axis.

9. A device according to claim 8, wherein the automatic closure is controlled by hydraulic means adapted to delay the commencement and the end of the closure movement.

* * * * *